US007358953B2

(12) United States Patent
Makuuchi et al.

(10) Patent No.: US 7,358,953 B2
(45) Date of Patent: Apr. 15, 2008

(54) SEMICONDUCTOR DEVICE AND TESTING METHOD OF SEMICONDUCTOR DEVICE

(75) Inventors: Masami Makuuchi, Yokohama (JP); Kengo Imagawa, Fujisawa (JP); Norio Chujo, Tokyo (JP); Ritsuro Orihashi, Tokyo (JP); Yoshitomo Arai, Ome (JP); Atsushi Obuchi, Higashiyamato (JP)

(73) Assignee: Renesas Technology Corp., Tokyo (JP)

( * ) Notice: Subject to any disclaimer, the term of this patent is extended or adjusted under 35 U.S.C. 154(b) by 383 days.

(21) Appl. No.: 10/714,943

(22) Filed: Nov. 18, 2003

(65) Prior Publication Data

US 2004/0189564 A1 Sep. 30, 2004

(30) Foreign Application Priority Data

Mar. 28, 2003 (JP) ..... 2003-091313

(51) Int. Cl.
*G09G 3/36* (2006.01)

(52) U.S. Cl. ..... 345/100; 345/55; 345/690; 345/904

(58) Field of Classification Search ..... 345/100, 345/690, 55, 904
See application file for complete search history.

(56) References Cited

U.S. PATENT DOCUMENTS

| | | | | |
|---|---|---|---|---|
| 6,339,388 | B1 * | 1/2002 | Matsumoto | 341/120 |
| 6,766,266 | B1 * | 7/2004 | Sakaguchi | 702/117 |
| 6,781,535 | B2 * | 8/2004 | Lee | 341/144 |

FOREIGN PATENT DOCUMENTS

| | | |
|---|---|---|
| JP | 62-094023 | 4/1987 |
| JP | 04-231885 | 8/1992 |
| JP | 2002-197899 | * 12/2002 |
| WO | WO 97/11428 | 3/1997 |

* cited by examiner

*Primary Examiner*—Richard Hjerpe
*Assistant Examiner*—Leonid Shapiro
(74) *Attorney, Agent, or Firm*—Antonelli, Terry, Stout & Kraus, LLP.

(57) ABSTRACT

A semiconductor device having a liquid crystal driving circuit is disclosed. The driving circuit includes a digital functional unit and an analog functional unit. The digital functional unit is comprised of a display controller and a display data storage RAM, while the analog functional unit is made up of a gradation voltage generating circuit and a gradation voltage selecting circuit. The digital and analog function units are functionally divided from each other and testing of the digital function and testing of the analog function unit are performed in an overlapping manner independently from each other.

15 Claims, 11 Drawing Sheets

FIG. 6

| TONE SETUP DATA | ENABLE SIGNAL | POLARITY INVERSION SIGNAL | VOLTAGE SELECT SIGNAL | TONE VOLTAGE GENERATION CIRCUIT | | | | | | | | TONE OUTPUT Vout |
|---|---|---|---|---|---|---|---|---|---|---|---|---|
| | | | | V1' | V2' | V3' | V4' | V5' | V6' | V7' | V8' | |
| 0 | 0 | DON'T CARE | DON'T CARE | V1 | V2 | V3 | V4 | V5 | V6 | V7 | V8 | V1 |
| 1 | | | | | | | | | | | | V2 |
| 2 | | | | | | | | | | | | V3 |
| 3 | | | | | | | | | | | | V4 |
| 4 | | | | | | | | | | | | V5 |
| 5 | | | | | | | | | | | | V6 |
| 6 | | | | | | | | | | | | V7 |
| 7 | | | | | | | | | | | | V8 |
| 0 | 1 | 0 | SAME AS TONE SETUP DATA | VH | VL | VL | VL | VL | VL | VL | VL | VH |
| 1 | | | | VL | VH | VL | VL | VL | VL | VL | VL | VH |
| 2 | | | | VL | VL | VH | VL | VL | VL | VL | VL | VH |
| 3 | | | | VL | VL | VL | VH | VL | VL | VL | VL | VH |
| 4 | | | | VL | VL | VL | VL | VH | VL | VL | VL | VH |
| 5 | | | | VL | VL | VL | VL | VL | VH | VL | VL | VH |
| 6 | | | | VL | VL | VL | VL | VL | VL | VH | VL | VH |
| 7 | | | | VL | VL | VL | VL | VL | VL | VL | VH | VH |
| 0 | | 1 | | VL | VH | VH | VH | VH | VH | VH | VH | VL |
| 1 | | | | VH | VL | VH | VH | VH | VH | VH | VH | VL |
| 2 | | | | VH | VH | VL | VH | VH | VH | VH | VH | VL |
| 3 | | | | VH | VH | VH | VL | VH | VH | VH | VH | VL |
| 4 | | | | VH | VH | VH | VH | VL | VH | VH | VH | VL |
| 5 | | | | VH | VH | VH | VH | VH | VL | VH | VH | VL |
| 6 | | | | VH | VH | VH | VH | VH | VH | VL | VH | VL |
| 7 | | | | VH | VH | VH | VH | VH | VH | VH | VL | VL |

SEMICONDUCTOR DEVICE AND TESTING METHOD OF SEMICONDUCTOR DEVICE

BACKGROUND OF THE INVENTION

The present invention relates to semiconductor devices having liquid crystal driving circuitry and also to testing methods thereof. More particularly, but not exclusively, this invention relates to useful techniques for application to a liquid crystal driving circuit which selects a predetermined level of voltage based on data as accommodated in a storage unit and then outputs it to a respective one of multiple external terminals.

The technologies that the present inventors have studied encompass those relating to liquid crystal driving circuits such as generally used color thin-film transistor (TFT) drivers for mobile use, one of which is configured as shown in FIG. 11, for example. This liquid crystal driver circuit is operable to hold the data which are written into a display data storage random access memory (RAM) 12 through an external interface in a line buffer 31 in units of lines of liquid crystal display data and then select, in each switch circuit 34 within a gradation voltage selecting circuit 33, a gradation or gray-scale voltage with a predetermined level generated at a gradation voltage generating circuit 32 on the basis of the liquid crystal display data being held in the line buffer 31 to thereby output it to each output terminal. And, in responding to a gradation/gray-scale voltage generated by this liquid crystal driver circuit, each picture element or "pixel" of a liquid crystal display (LCD) panel is electrically charged up to a hold capacitance amount whereby the brightness or luminance of each pixel is controlled on the LCD panel side.

At the time of testing this liquid crystal driver circuit, it is arranged to perform several operations which follow. Apply an arbitrary test pattern to the liquid crystal driver circuit from a tester 35 through an external interface. Then, write data into the display data RAM 12 and execute control of a display controller 11, thereby causing a given gradation voltage to output toward an output terminal from each switch circuit 34 within the gradation voltage selector circuit 33. This output voltage is measured by the tester 35 to thereby perform the test required.

As explained above, the liquid crystal driver circuit is such that a digital functional unit which is comprised of the display controller and the display data RAM and an analog functional unit made up of the gradation voltage generator circuit and gradation voltage selector circuit operate together in an integral or united way. Accordingly, in the case of implementation of digital functional tests of the liquid crystal driver circuit, a need is felt to measure a prespecified potential level of gradation voltage to be output from the output terminal. The liquid crystal driver circuit is faced with problems which follow: it is difficult to increase the driving ability or "drivability" of any gradation voltage output for the purpose of lowering power consumption and, for this reason, it is impossible to realize speed-up or acceleration of a gradation voltage measurement; on the other hand, due to an increase in number of test items in accordance with the quest for higher performances, the test time increases so that it becomes difficult to reduce costs.

Additionally in the above-noted liquid crystal driver circuit, the one such as shown in FIG. 12 is considered, which is constituted from a gradation voltage generator circuit 32 and a gradation voltage selector circuit 33 (switch circuits 34). In this gradation voltage generator circuit 32, a gradation or gray-scale voltage with any given n tone levels is generated by potentially dividing a gradation generation voltage V0 into n portions at a given rate, while using the voltage V0 as a reference. And, in each switch circuit 34 which is disposed within the gradation voltage selector circuit 33, a given gradation voltage is selected and output in a way pursuant to the gradation setup data being presently held in the line buffer.

In this liquid crystal driver circuit, when performing testing of the gradation voltage at output terminals, use the gradation setup data being set in the line buffer to set an output voltage of each output terminal at a prespecified gradation voltage value; then, perform voltage measurement by using an analog-to-digital (AD) converter or the like on a per-output terminal basis. This is measured with respect to all the gradation voltages to thereby perform the test. Accordingly, the prior known approach has the following problems to be solved: it is difficult to shorten the length of a test time period and speed up the test due to the presence of a limitation to the above-noted gradation output voltage drivability; and, the test time increases with an increase in number of output terminals of the liquid crystal driver circuit in a way corresponding to a growth in high precision of LCD panels or alternatively an increase in number of gradation or tone levels, resulting in difficulty of cost reduction.

In order to solve these problems, a technique for acceleration of the test has been proposed, which is disclosed for example in JP-A-2002-197899. This technique aims at shortening of the test time by employing an arrangement in which the liquid crystal driver circuit performs a gradation test while retaining liquid crystal display data in a storage circuit such as a line buffer through the display data RAM and, at the same time, interrupts writing into the line buffer to thereby perform testing of the display data RAM.

SUMMARY OF THE INVENTION

Incidentally, as for the techniques taught by the JP-A-2002-197899, the studies conducted by the present inventors have revealed the fact which follows. Although in the above-referenced JP-A the technique for acceleration of the test procedure is proposed, it is required to realize further shortening of the test time in order to lower the cost of the liquid crystal driver circuit in a way corresponding to a growth in high functional of the liquid crystal driver circuit and also an increase in output terminal number. Moreover, while the above-referenced JP-A suggests that it is possible to execute both a functional test of the display data RAM per se and an electrical characteristics test by utilizing the data as stored in the line buffer in a parallel way, this citation fails to provide any detailed teachings as to functional division and test items.

It is therefore an object of the present invention to provide a testing technique of a semiconductor device having a liquid crystal driving circuit, which is capable of achieving, even for advances in high functional and an increase in output terminal number, further reduction of a test time period by functionally dividing the liquid crystal driving circuit into portions and controlling the divided portions independently of each other to thereby enable testing, and thus makes it possible to accelerate the test and further accomplish low costs.

To attain the above object, this invention provides circuitry which has a digital functional unit and an analog functional unit and also has, in addition thereto, a first terminal for outputting a test result of the digital functional unit toward the outside, wherein the digital functional unit and analog functional unit are functionally divided to thereby permit an output of the digital function unit to be output toward the outside of the liquid crystal driver circuit. Alternatively, circuitry is provided which has a second terminal for controlling the test of the analog function unit from the outside, thereby controlling a gradation voltage selector circuit from the outside of the liquid crystal driver circuit in a way independent of the digital function unit. Additionally, an arrangement is provided for performing the testing of the digital function unit independently of the analog function unit. Whereby, it is possible to achieve high-speed functional tests while letting the test of the digital function unit be independent of the analog function unit.

The invention also provides an arrangement which has a changeover means for changing an output of a gradation voltage generating circuit included in the analog function unit to a two-level voltage value and which changes or switches an output voltage of the gradation voltage generator circuit to a two-level voltage to thereby selectively set each gradation or tone voltage at any one of different two-level voltages. Whereby, the output voltage of the liquid crystal driver circuit is converted into a two-level voltage, thus enabling achievement of high-speed gradation or gray tone output tests.

Other objects, features and advantages of the invention will become apparent from the following description of the embodiments of the invention taken in conjunction with the accompanying drawings.

BRIEF DESCRIPTION OF THE DRAWINGS

FIG. 6 is an explanation diagram showing a relationship of gradation outputs versus each signal of the gradation voltage generator circuit and the gradation voltage selector circuit in one embodiment of the invention.

DETAILED DESCRIPTION OF THE EMBODIMENTS

Figure 1:
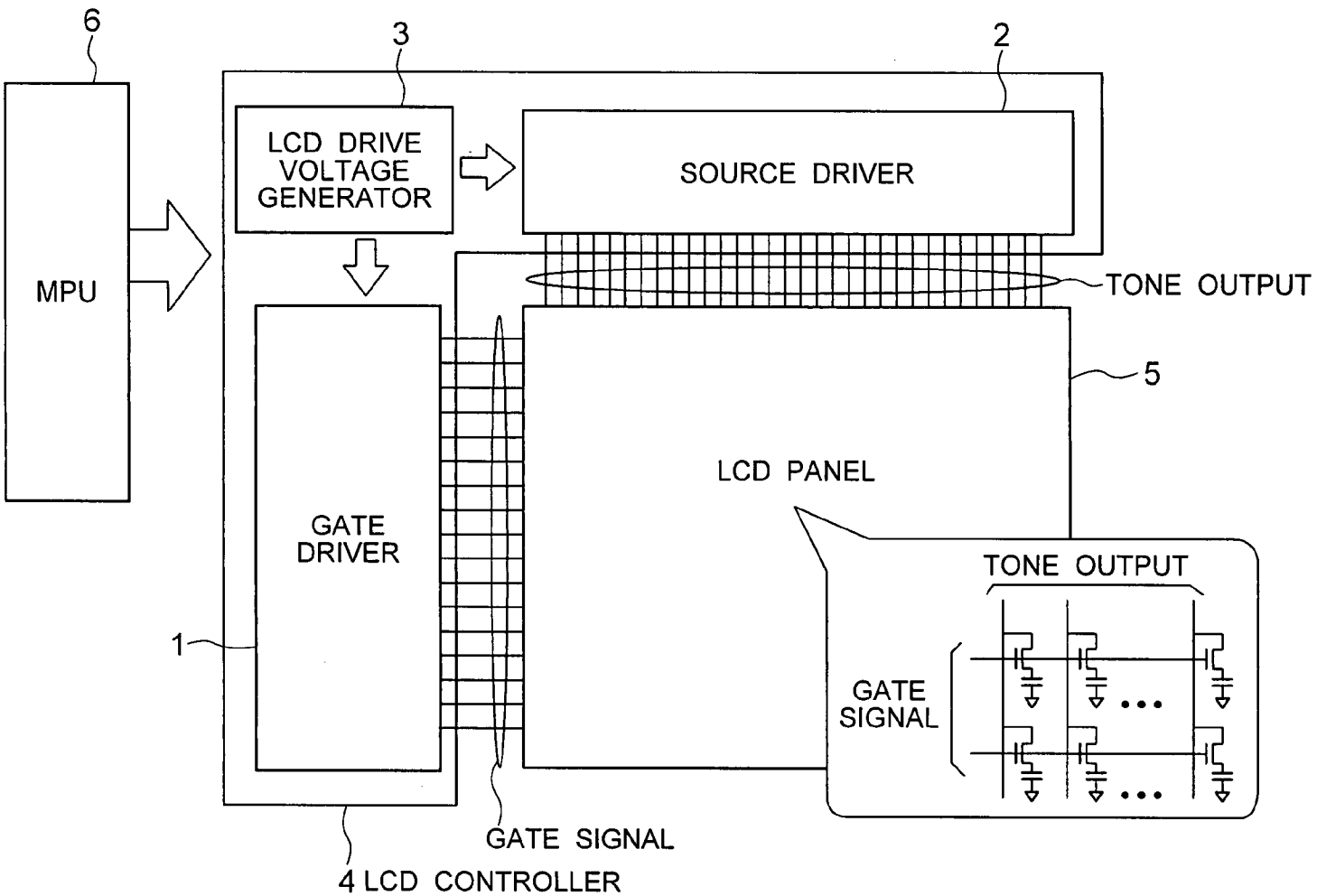
FIG. 1 is a diagram showing a configuration of a semiconductor device having a liquid crystal driving circuit in accordance with one embodiment of the present invention.

Embodiments of the present invention will be explained in detail based on the accompanying drawings below. It should be noted that in all the drawings for explanation of the embodiments, components or members having the same function are denoted by the same reference character, with repetitive explanations thereof omitted herein.

An explanation will first be given of one example of the configuration and operation of a semiconductor device which has a liquid crystal driving circuit in accordance with one embodiment of this invention. FIG. 1 is an arrangement diagram of the semiconductor device having the liquid crystal driver circuit of this embodiment.

The semiconductor device having the liquid crystal driver circuit of this embodiment is applicable, for example, to color TFT liquid crystal drivers for mobile use or the like and is arranged as a liquid crystal display (LCD) controller 4 which includes a gate driver 1 for applying a gate signal to an LCD panel 5, a source driver 2 for applying a gradation or gray-scale output voltage to the LCD panel, a liquid crystal drive voltage generating circuit 3 for generating a drive voltage of the LCD panel and so forth. This LCD controller 4 is formed as a single chip of semiconductor device. Optionally, it is also possible to configure the controller as a single semiconductor device by letting it also include therein a micro-processor unit (MPU) as will be described later.

This LCD controller 4 is connected to the LCD panel 5 with TFTs disposed in a matrix form. By supplying a gate signal for selection of an arbitrary display line to this LCD panel 5 from the gate driver 1 and applying a gradation or tone-level output voltage from the source driver 2 to each pixel of this selected display line, electrical charge-up is done to the hold capacitance of a target pixel whereby the luminance of each pixel is controlled appropriately.

The LCD controller 4 is also connected to the MPU 6. The MPU 6 is operable to control arithmetic processing of each operation.

Figure 2:
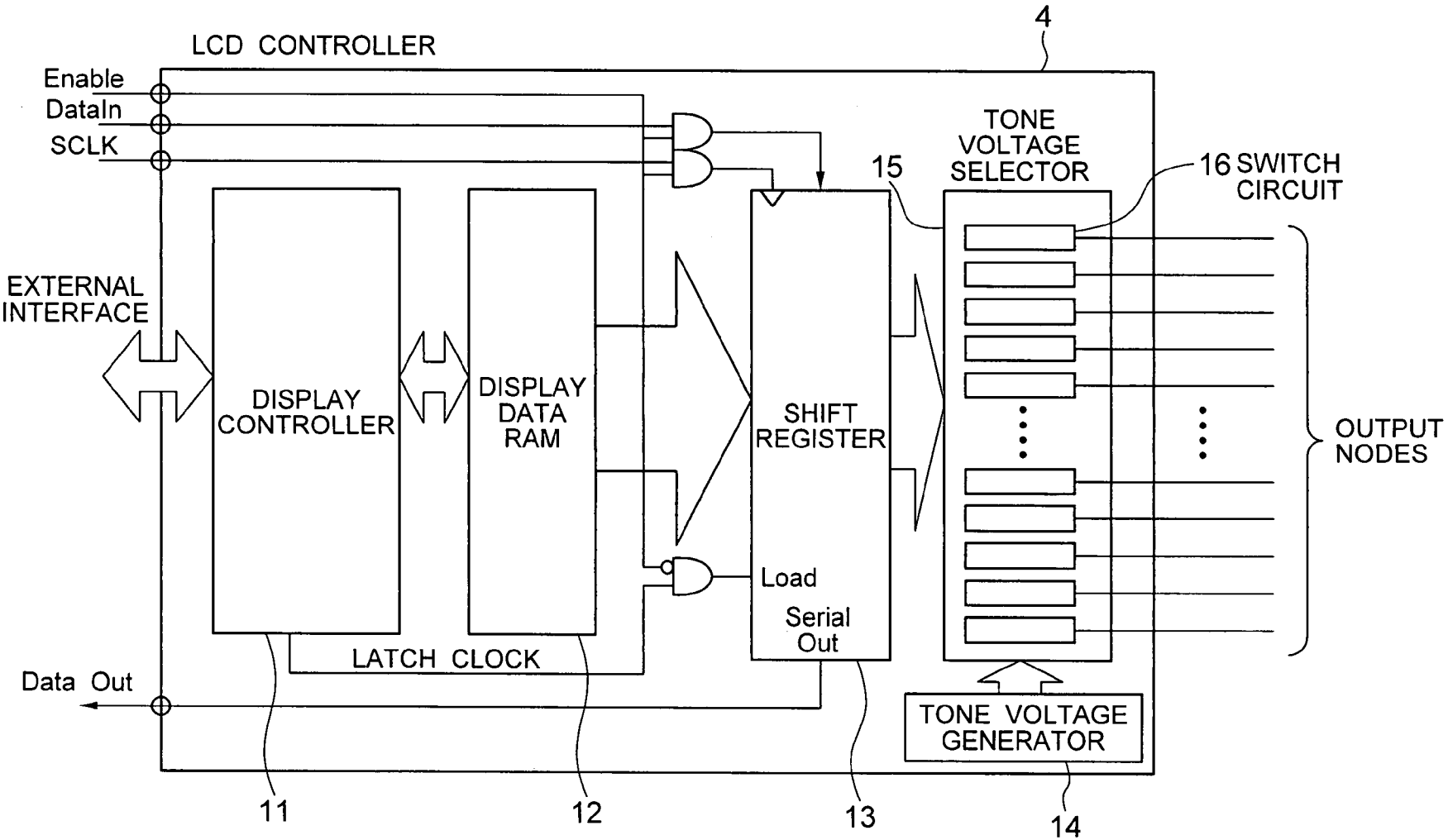
FIG. 2 is a diagram showing a configuration of a liquid crystal driver circuit in one embodiment of this invention.

An explanation will next be given of one example of the arrangement and operation of the liquid crystal driver circuit of this embodiment with reference to FIG. 2. FIG. 2 is a diagram showing a configuration of the liquid crystal driver circuit of this embodiment.

The liquid crystal driver circuit of this embodiment is applicable, for example, to the above-stated gate driver 1 shown in FIG. 1. A liquid crystal display (LCD) controller 4 including this gate driver 1 is generally made up of a display controller 11 for controlling writing and reading of data through an external interface, a display data RAM 12 for storage of write or read data, a shift register (hold means) 13 which holds the data as written into this display data RAM 12, a gradation voltage generating circuit 14 operable to generate a gradation or gray-scale voltage with prespecified tone levels, and a gradation voltage selector circuit 15 for selection of a certain level of gradation voltage as generated from this gradation voltage generator circuit 14. The gradation voltage selector circuit 15 includes therein a plurality of switch circuits 16. In the LCD controller 4, a digital functional module or unit is constituted from the display controller 11 and display data RAM 12, whereas an analog functional unit is configured from the gradation voltage generator circuit 14 and gradation voltage selector circuit 15.

The LCD controller 4 is arranged so that at the time of normal operations, the display controller 11 is connected to the MPU 6 through the external interface and also connected to the LCD panel 5 via output terminals from the gradation voltage selector circuit 15. Additionally, an enable (Enable) terminal, data input (DataIn) terminal and shift clock (SCLK) terminal are coupled to ground potential at external portions, while a data output (DataOut) terminal is set in an open state on the outside. In contrast, on the inside, respective signals coming from the Enable terminal and DataIn terminal and signals from Enable terminal and SCLK terminal are input to the shift register 13 through logic gates; the signal from Enable terminal and a latch clock signal from the display controller 11 are input via a logic gate to the shift register 13 as a "Load" input; and, a signal from the shift register 13 is output as a "SerialOut" output from a "DataOut" terminal.

Figure 11:
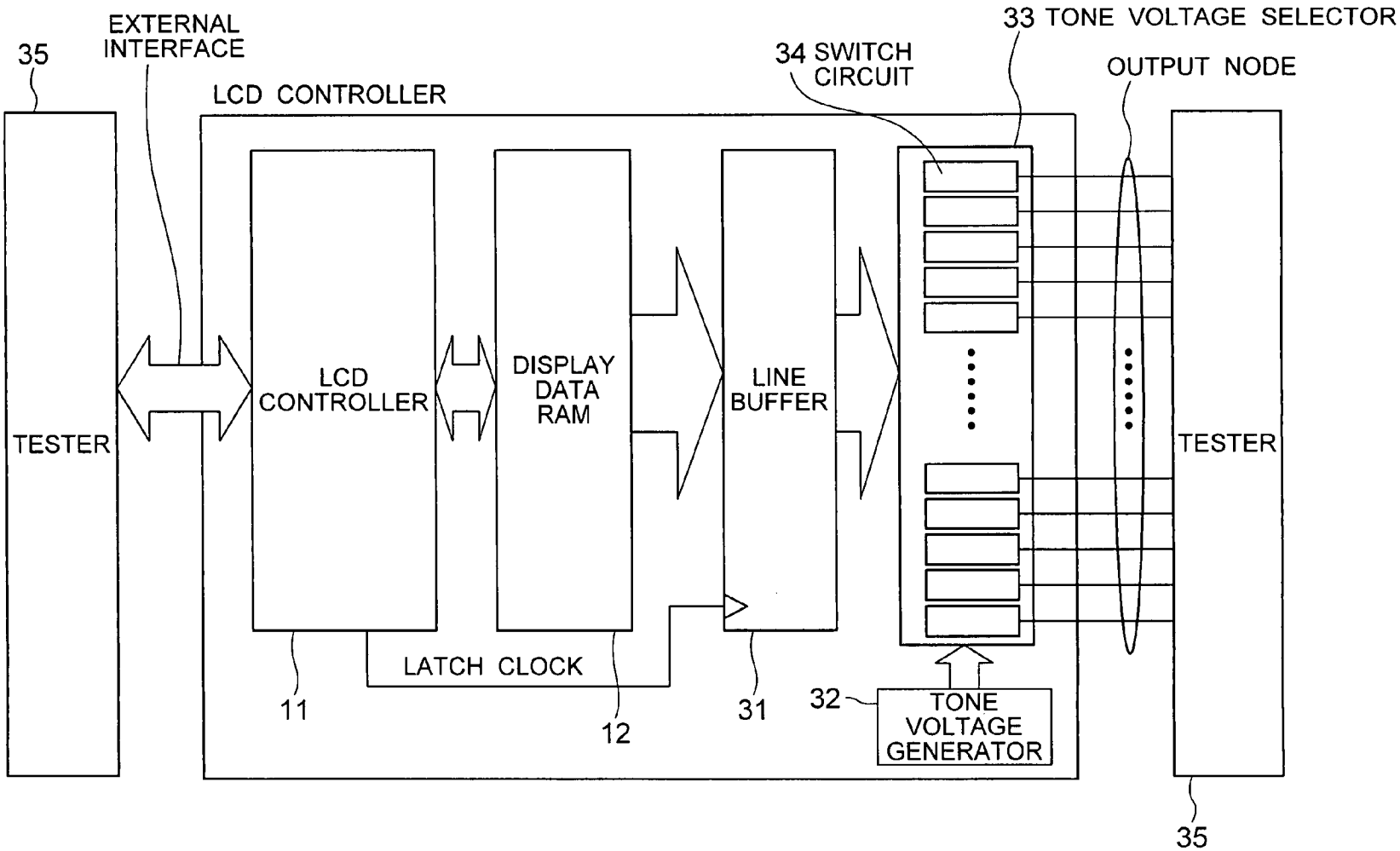
FIG. 11 is a diagram showing a configuration of one prior known liquid crystal driver circuit, which was studied as a related art of the present invention.

During normal operations, in this connection state, the "Load" input of the shift register 13 through the Enable terminal is set to be valid, and any inputs of the DataIn and SCLK terminals are set in an invalid state. An output of the display data RAM 12 is retained in the shift register 13 by a latch clock signal as output from the display controller 11. In responding to the output of this shift register 13, the gradation voltage selector circuit 15 is controlled to output a specified gradation voltage toward an output terminal, thus performing an operation which is similar to that of the prior art circuit (FIG. 11).

In the LCD controller 4 also, at the time of testing the digital and analog functional units, the external interface to the display controller 11, output terminals from the gradation voltage selector circuit 15, Enable terminal (second terminal), DataIn terminal (second terminal), SCLK terminal (second terminal) and DataOut terminal (first terminal) are each connected to a tester so that a variety of kinds of tests are performed by using signals from this tester. Here, an explanation will be given in brief of only those operations at the time of testing the digital and analog functional units: various kinds of test items will be described in detail later.

At the time of testing the digital functional unit, after having held an output of the display data RAM 12 in the shift register 13 in the same state as that during normal operations, the Load input of shift register 13 is set in an invalid state through Enable terminal and inputs of the DataIn and SCLK terminals are set in a valid state. Then, a shift clock signal is input from the SCLK terminal to sequentially read the output of the display data RAM 12 that is presently held in the shift register 13 toward the outside through the DataOut terminal, thereby to perform comparison and determination or "judgment" with respect to an expected value.

On the other hand, during testing of the analog functional unit, the Load input of the shift register 13 is set in the invalid state through Enable terminal while the inputs of DataIn and SCLK terminals are set in the valid state. Then, prespecified data which is synchronized with the shift clock being input from the SCLK terminal is set to the DataIn terminal and then the data is set in the shift register 13. Thus it is possible to perform and implement a functional test of the gradation voltage selector circuit 15 independently of the digital functional unit.

Figure 3:
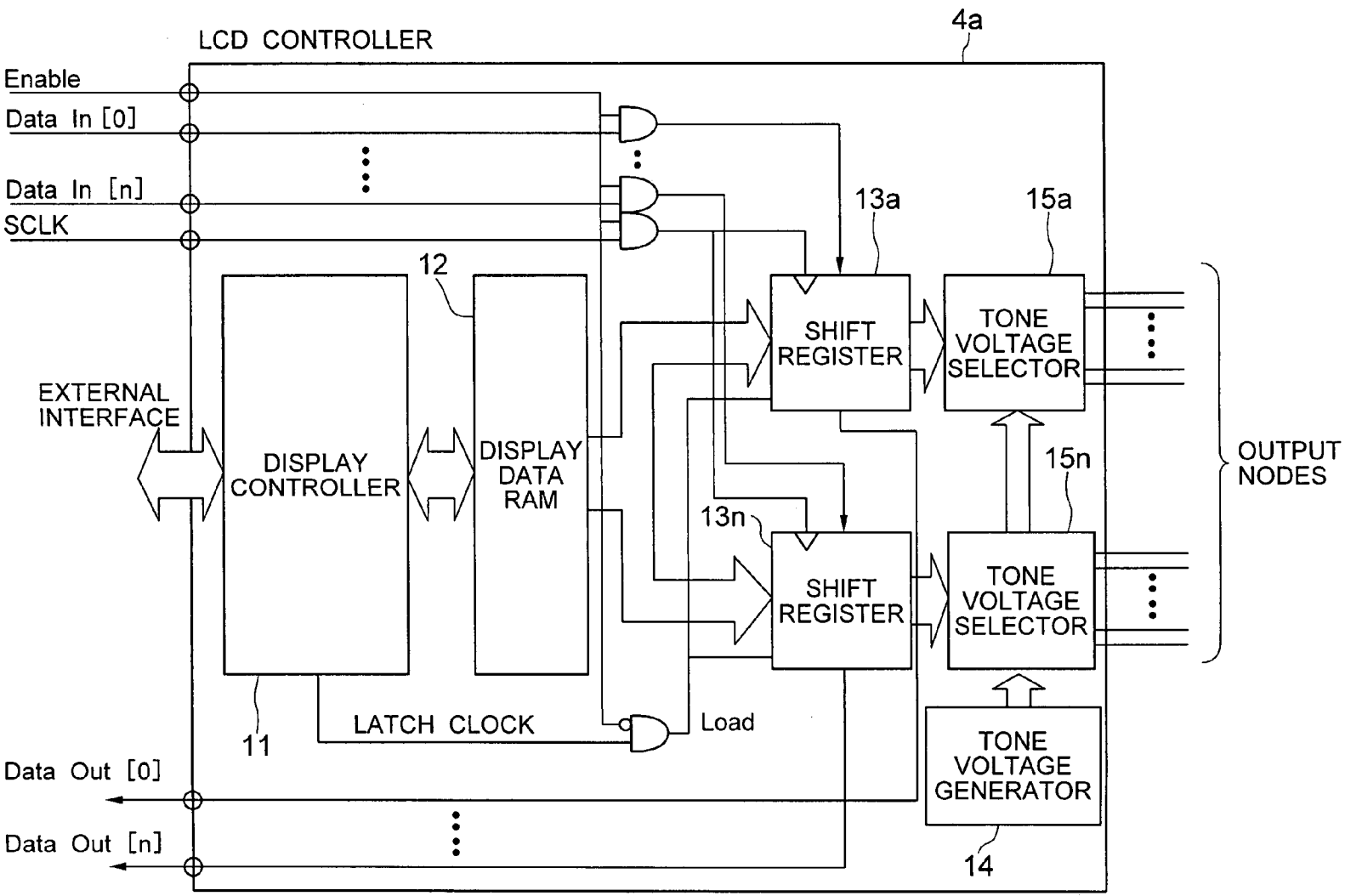
FIG. 3 is a diagram showing a configuration of a liquid crystal driver circuit in case a shift register is divided into N portions in one embodiment of the invention.

An explanation will next be given of one example of the arrangement and operation of the liquid crystal driver circuit in case the shift register is divided into N portions in this embodiment, with reference to FIG. 3. FIG. 3 is a diagram showing a configuration of the liquid crystal driver circuit in the case of N division of the shift register.

As shown in FIG. 3, a liquid crystal display (LCD) controller 4*a* is arranged to N-divide its output terminals and, based upon this arrangement, also N-divided the shift register 13 and the gradation voltage selector circuit 15. For the resultant N shift registers 13*a* to 13*n*, a corresponding number, N (0 to n), of DataIn terminals and DataOut terminals are provided. With such an arrangement, it is possible to shorten a time required to read the hold data out of shift registers 13*a* to 13*n* and a time taken to set data in the shift registers 13*a*-13*n* so that the hold data read time and the data set time are each equal to 1/N of that of the above-mentioned LCD controller 4 shown in FIG. 2.

Additionally, in the LCD controllers 4 and 4*a* shown in FIGS. 2 and 3, those terminals such as the DataIn terminal, DataOut terminal and SCLK terminal are the ones that are out of use at the time of normal operations; thus, it is possible to selectively use them in such a way that these terminals are replaced with or "switched" to external interface terminals in accordance with the presence or absence of test implementation. This makes it possible to permit common use or "sharing" with the terminals which have been used in the prior art circuit (FIG. 11). It is readily understandable that the use of an input/output changeover or switching circuit within the LCD controller makes it possible to achieve the sharing of the DataIn and DataOut terminals.

Figure 4:
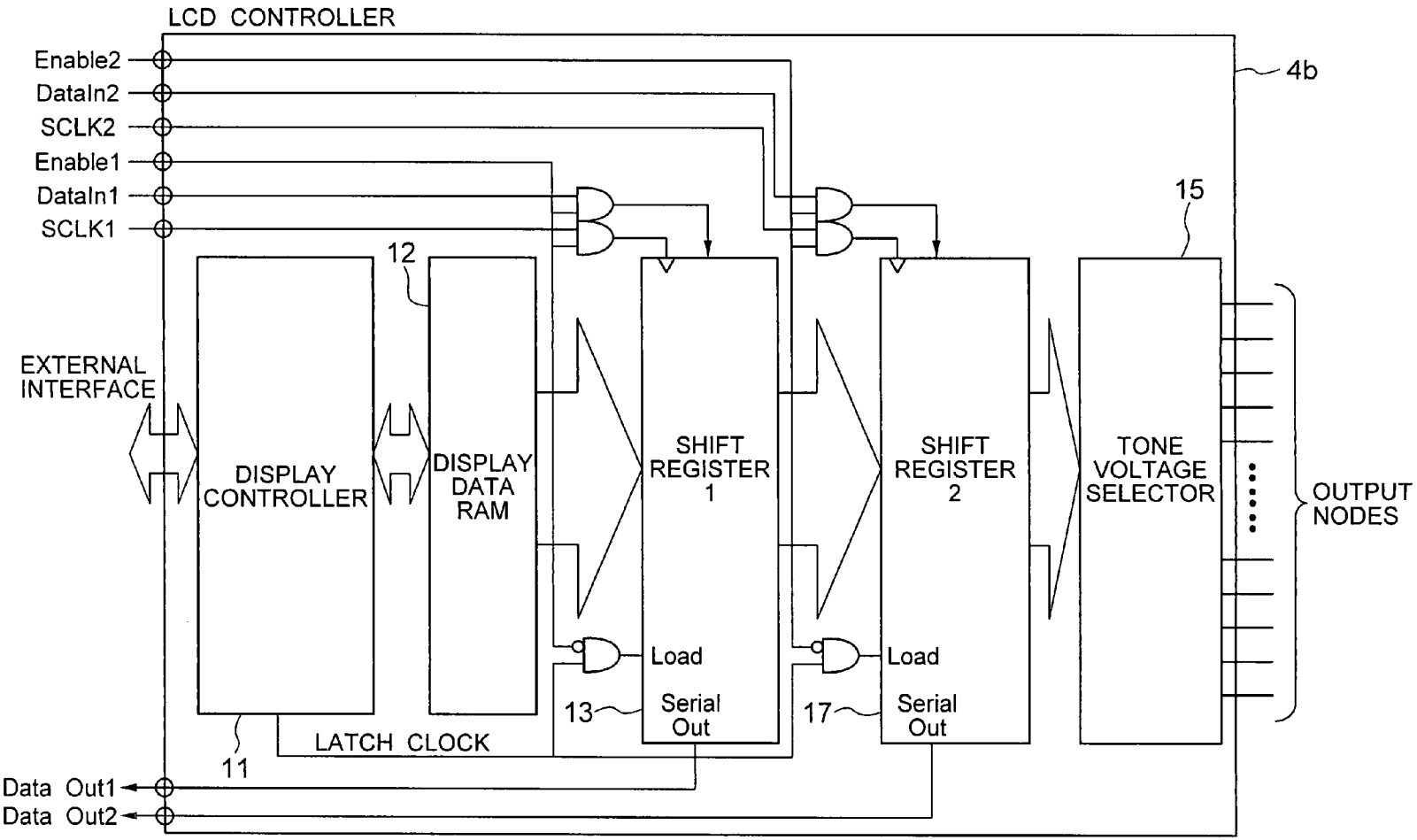
FIG. 4 is a diagram showing a configuration of a liquid crystal driver circuit in case the shift register is designed to have two stages in one embodiment of the invention.

An explanation will next be given of one example of the arrangement and operation of the liquid crystal driver circuit in case its shift register is designed to have a two-stage configuration in this embodiment, with reference to FIG. 4. FIG. 4 is a diagram depicting a configuration of the liquid crystal driver circuit in the case of such two-stage shift register.

As shown in FIG. 4, a liquid crystal display (LCD) controller 4*b* is arranged so that a shift register (1) 13 for storing and holding output data of the display data RAM 12 and a shift register (2) 17 for control of the gradation voltage selector circuit 15 are provided and disposed therein. With such an arrangement, it is possible to execute, in a parallel way, a display functional test through the display data RAM 12 from the display controller 11 and a gradation or tone-level output test of the circuitry including the gradation voltage generator circuit 14 and gradation voltage selector circuit 15 while at the same time shortening the test time period required therefor.

More specifically, in the display functional test, hold any given output data of the display data RAM 12 in the shift register (1) 13 and then apply a shift clock from the tester through an SCLK (1) terminal to thereby perform a comparative determination with an expected value via a DataOut (1) terminal. In addition, simultaneously in this procedure, gradation setup data is set in the shift register (2) 17 from the tester via a DataIn (2) terminal; then, the tester is used to perform comparative judgment thereof with the expected value through an output terminal(s).

It should be noted that at the time of normal operations, let the same latch clock be loaded and input to both the shift register (1) 13 and the shift register (2) 17, whereby it is possible to perform a display operation while holding any given data of the display data RAM 12 in the shift register (2) 17.

Although some principles for realization of the parallel test routine are described here, modifications and alternations are also available. For example, the DataIn (1) terminal and DataIn (2) terminal may be modified to have an ability to selectively input a signal from the same input terminal. Alternatively, the DataOut (1) terminal and DataOut (2) terminal also may be designed so that these can selectively output a signal to the same output terminal. Also note that since these signals are inherently out of use during normal operations, it is possible to provide selective usage while changing or switching them for replacement with an external interface terminal(s) in accordance with the presence or absence of the test implementation. Obviously, it is possible to permit common use or sharing with the terminals as have been used in the prior art circuit (FIG. 11).

Figure 5:
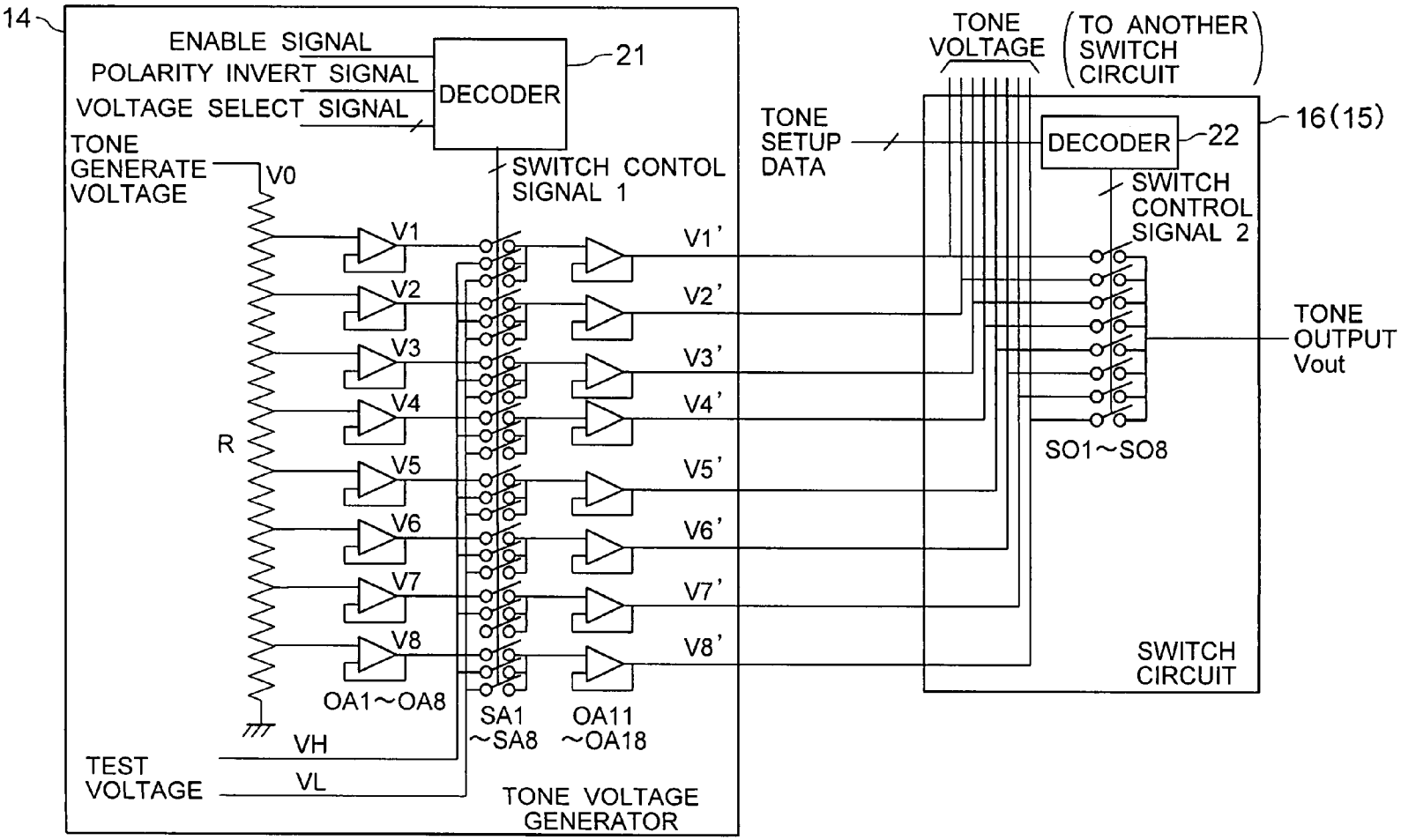
FIG. 5 is a circuit diagram showing a gradation voltage generator circuit and a gradation voltage selector circuit in one embodiment of the invention.

An explanation will next be given, by using FIGS. 5 and 6, of one example of the arrangement and operation of the gradation voltage generator circuit and gradation voltage selector circuit making up the liquid crystal driver circuit in this embodiment. FIG. 5 is a circuit diagram of the gradation voltage generator circuit and gradation voltage selector circuit, and FIG. 6 is a diagram for explanation of the relationship of each signal versus gradation or tone-level outputs.

As shown in FIG. 5, the gradation voltage generator circuit 14 includes, but not limited to, a voltage-dividing resistor R for n potential division of a gradation generating voltage V0 at an arbitrary rate, a plurality of operational amplifiers OA1 to OA8 operable to amplify each potentially divided voltage obtainable from this voltage-divider resistor R, a plurality of switches (changeover means) SA1 to SA8 for changing over or switching output voltages of respective op-amps OA1-OA8 and test-use voltages VH and/or VL, a plurality of opamps OA11-OA18 each of which operates to amplify a switched voltage by a corresponding one of the switches SA1-SA8, and a decoder circuit (changeover means) 21 for controlling changeover of respective switches SA1-SA8. The gradation voltage generator circuit 14 is arranged to provide the capability to change or "convert" an output of this circuit 14 into a predetermined two-level voltage value of either VH or VL.

The gradation voltage selector circuit 15 generally includes a plurality of switch circuits 16 corresponding to respective display lines of the LCD panel. Each switch circuit 16 includes a plurality of switches SO1 to SO8 for turning on and off (ON/OFF) an output of the gradation voltage generator circuit 14, a decoder circuit 22 for control of ON/OFF of each switch SO1, . . . , SO8 and so forth. Output signals from the gradation voltage generator circuit 14 are input to the switches SO1-SO8, respectively, on the input sides thereof. These switches SO1-8 have their output sides which are commonly connected together at a circuit node Vout, from which a gradation voltage is output.

In the gradation voltage generator circuit 14 and gradation voltage selector circuit 15, an enable signal and a polarity inversion signal plus a voltage select signal are input to the decoder circuit 21 of gradation voltage generator circuit 14, which outputs a switch control signal (1) to thereby control the changeover or switching of each of switch SA1-SA8. In addition, gradation or gray-scale setup data is input to the decoder circuit 22 of switch circuit 16, which operates to output a switch control signal (2) to thereby control ON/OFF of each switch SO1, . . . , SO8. There is shown in FIG. 6 a relationship of an output signal of the gradation voltage generator circuit 14 and further a gradation output from each switch circuit 16 of the gradation voltage selector circuit 15 with respect to the settings of the gradation setup data and respective signals such as the enable signal, polarity inversion signal and voltage select signal.

In FIG. 6, when the enable signal stays at "0," the circuitry is in a normal operation state. In this state, the outputs V1-V8 of the gradation voltage generator circuit 14 are directly output as a gradation voltage with eight gray-scale or tone levels. On the other hand, when the enable signal is "1," a test state is established. In this state, the voltage select signal is set to be the same as the gradation setup data in the event that the polarity inversion signal is "0.", whereby all of the gradation outputs become at a high potential level of VH. Alternatively, in the case of setting the voltage select signal to be the same as the gradation setup data when the polarity inversion signal is "1," all of the gradation outputs are adversely set at a low potential level of VL.

In this way, in the liquid crystal driver circuit of this embodiment, the gradation voltage generator circuit 14 is arranged so that its output can be changed to either one of the two different voltage values of VH and VL. In response to the gradation setup data being set in the shift register 13, control the gradation voltages to be supplied to a selected switch and a non-selected switch within the gradation voltage selector circuit 15 so that these are at different voltage levels in a way which follows: if one of them is at VH then the other is at VL. Then, an external tester is used to let all the output terminals experience comparison with the expected value at the same time. Thereby, it is possible to speed-up the gradation output test.

Figure 12:
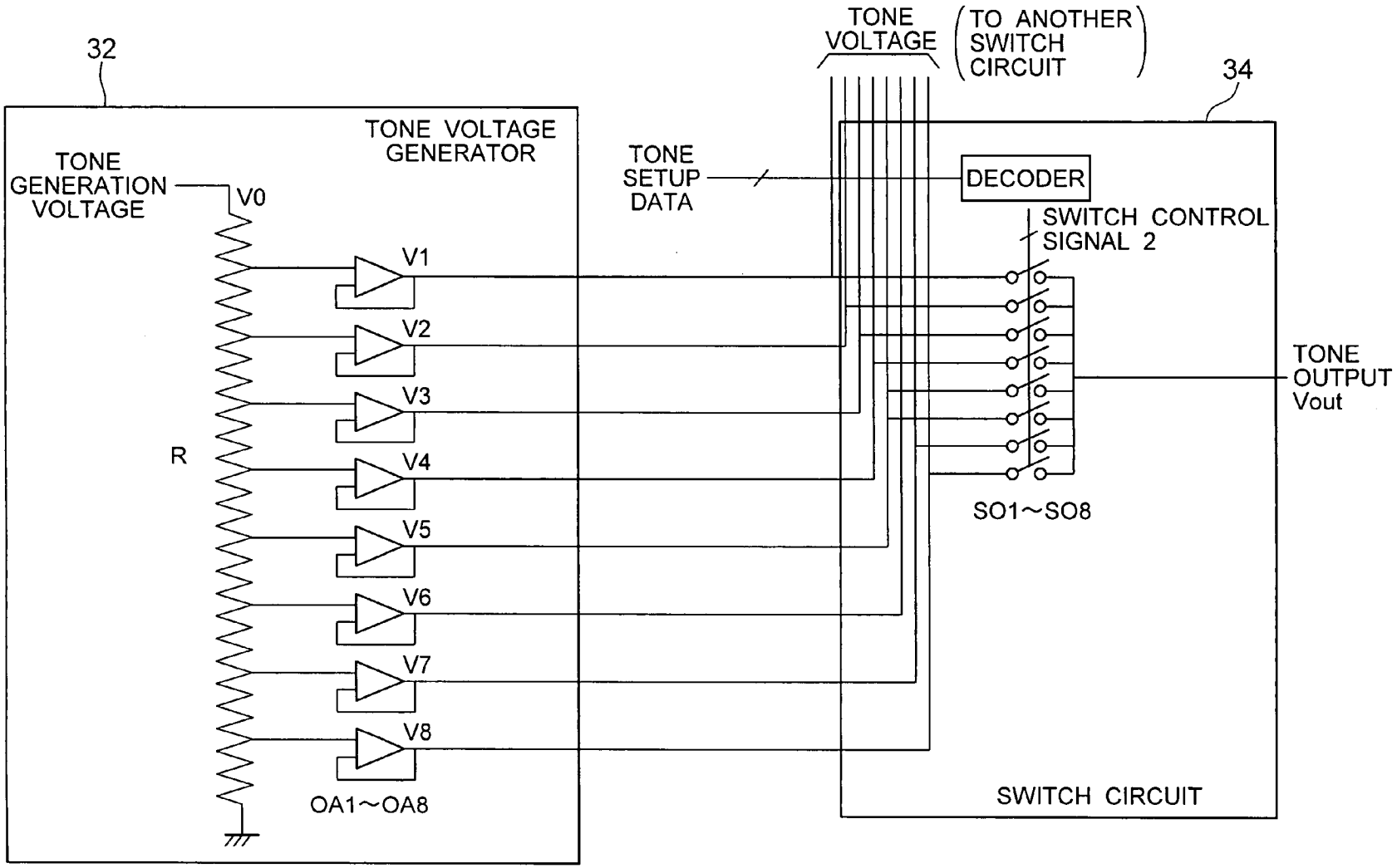
FIG. 12 is a circuit diagram showing prior art gradation voltage generator and gradation voltage selector circuits, which are studied as the related art of this invention.

In brief, it becomes possible for this embodiment to achieve acceleration of the gradation output test, by executing the gradation output test of the prior art circuit (FIG. 12) stated supra while replacing it with functional tests such as open-circuit or electrical short defect tests of the switches SO1-SO8 that make up the switch circuit 16 within the gradation voltage selector circuit 15.

It is noted that in the gradation voltage generator circuit 14, the output buffer circuit that is configured from the opamps OA11-OA18 may not be provided. Also obviously, the test-use voltages VH and VL may be replaced by any ones of the gradation voltages which are potentially n-divided from the gradation generating voltage V0.

Figure 7A:
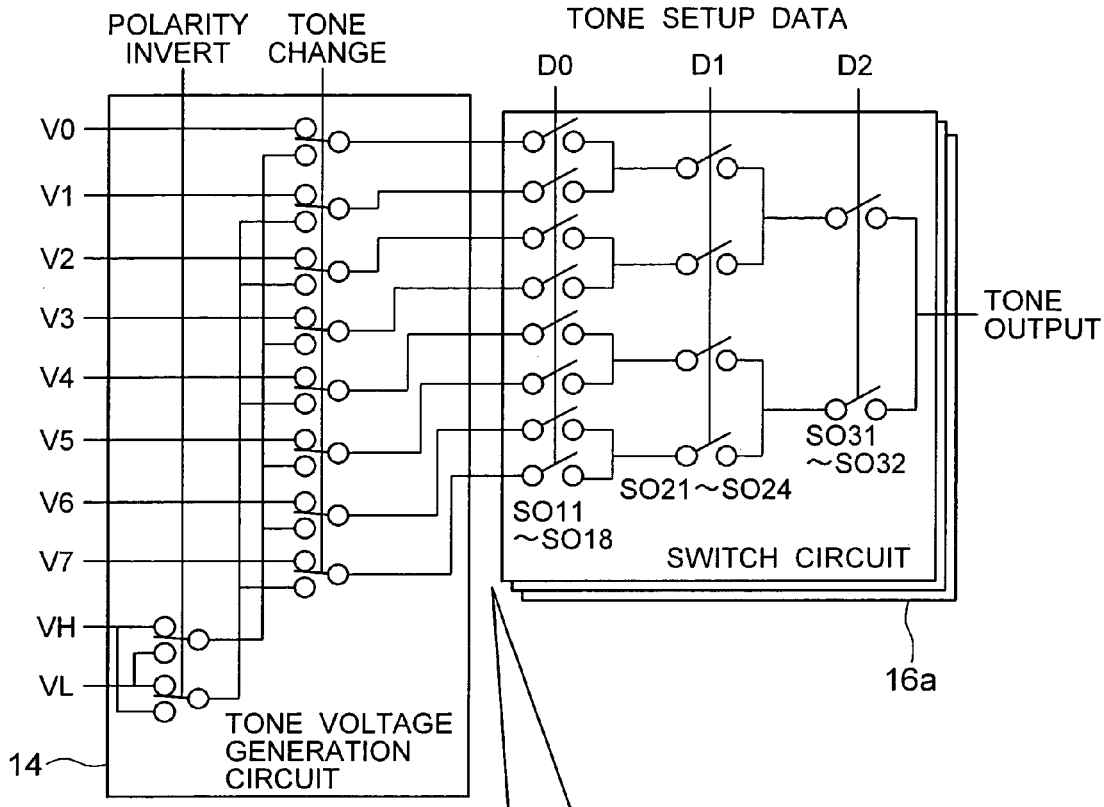
FIG. 7A. is a circuit diagram showing a case where switch circuits within the gradation voltage generator circuit are formed in a tournament form in one embodiment of the invention.

An explanation will next be given of one example of the arrangement and operation of the gradation voltage generator circuit in case the switch circuit used therein is formed to have a tournament form in this embodiment, with reference to FIGS. 7A and 7B. FIG. 7A is a circuit diagram of such gradation voltage generator circuit when the switch circuit within it is formed into the tournament form, and FIG. 7B is an explanation diagram of voltage values at the time of testing.

In case a switch circuit 16*a* within the gradation voltage selector circuit is formed in the tournament form, the circuit 16*a* is arranged in a way which follows: eight switches SO11 to SO18 are provided in a first stage thereof; four switches SO21-SO24 are provided at its second stage; and, two switches SO31 and SO32 are provided at a third stage, respectively. The first stage of switches is controlled by gradation setup data D0; similarly, the second stage and the third stage are controlled by D1 and D2 respectively to thereby output the gradation voltage required.

Within this switch circuit 16*a*, an output voltage of the gradation voltage generator circuit 14 is output as a two-level or "binary" voltage value in such a way that output signals of two sets of 2:1 selection branches become two values of voltage levels (VH and VL) which are different from each other at an input of the next stage of 2:1 selection branch. With this scheme, the output voltages of gradation voltage generator circuit 14 may be set at mutually different potential levels in a way irrespective of the ON or OFF state of each switch. Thus, it is possible to simplify two-level voltage changeover circuitry as built in the gradation voltage generator circuit 14.

Figure 7B:
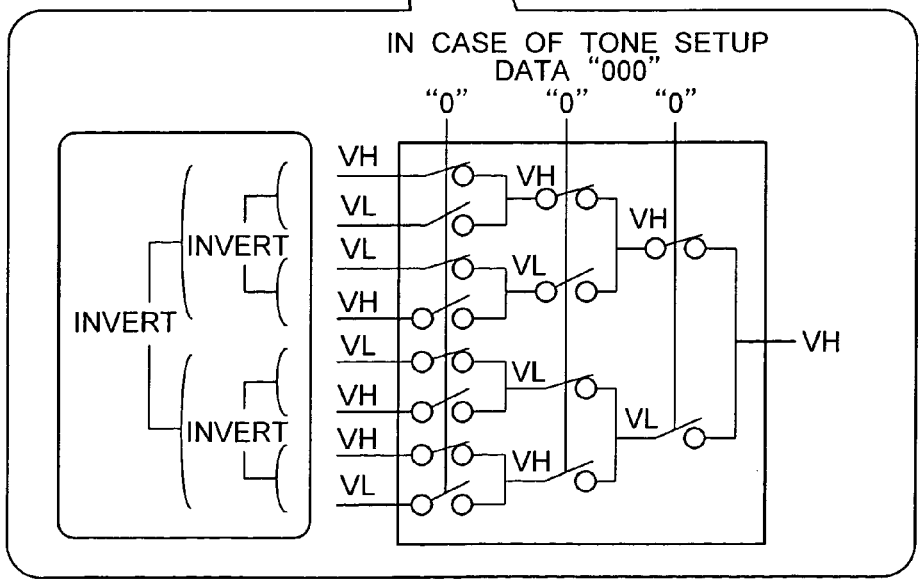
FIG. 7B is an explanation diagram showing voltage values at the time of testing.

For example, as shown in FIG. 7B, suppose that the gradation setup data is "000" at the time of testing. In this case, when sequentially setting the output voltages of the gradation voltage generator circuit 14 at VH, VL, VL, VH, VL, VH, VH and VL, output voltages of the first stage of switches SO11-SO18 become VH, VL, VL and VH in this order of sequence. At this time, output voltage of the second stage of switches SO21-SO24 become VH and VL in sequence; output voltages of the third stage of switches SO031-SO32 are at VH. Thus it is possible to finally output an output voltage of the switch circuit 16*a* as VH.

Figure 8:
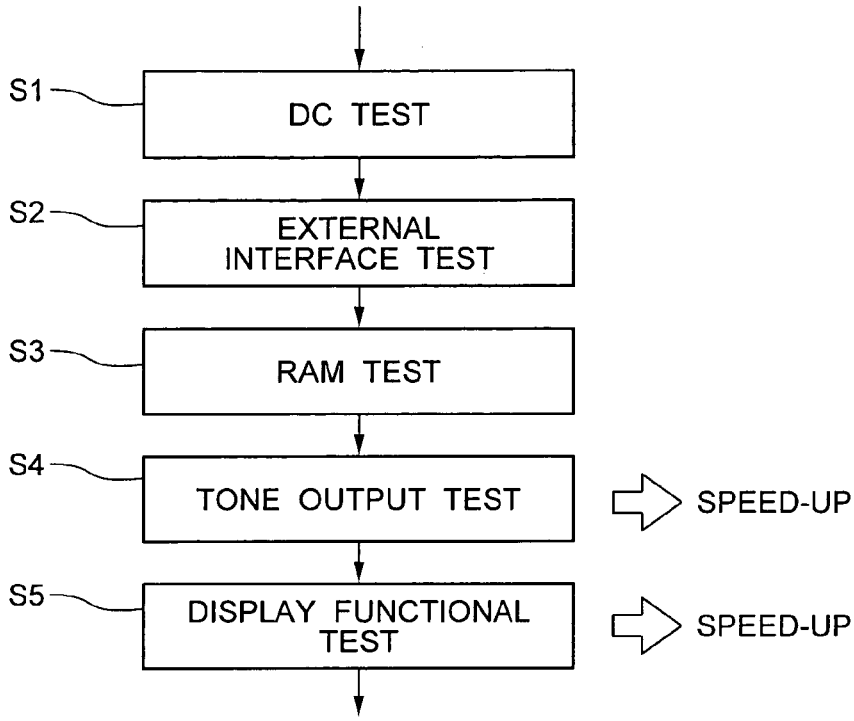
FIG. 8 is a test flow diagram showing a case for speed-up of the individual test items in one embodiment of the invention.

Next, an explanation will be given of one example of a test flow of a semiconductor device having the liquid crystal driver circuit of this embodiment, with reference to FIGS. 8 to 10. FIG. 8 is a test flow diagram in the case of accelerating the individual test items, FIG. 9 is a test flow diagram in case the test items are parallelized, and FIG. 10 is a test flow chart in another case for palallelization of the test items.

In a manufacturing process of the semiconductor device having the liquid crystal driver circuit, several tests are implemented to perform screening inspection for identifying good products from defective ones. Typical examples of the tests include, but not limited to, a direct current (DC) test which measures for evaluation a voltage, current and resistance value, an external interface test, a RAM test applied to the display data RAM by execution of writing and reading of any given data through the external interface, a gradation/gray-scale output test, and a display function test relative to an entirety of the liquid crystal driver circuit.

For instance, in this embodiment, as shown in FIG. 8, in the case of sequentially performing a DC test (at step S1), external interface test (step S2), RAM test (step S3), gradation output test (step S4), and display function test (step S5) of the individual test items, using the aforesaid schemes shown in FIGS. 2-4 makes it possible to speed up the display function test at step S5; in addition, use of the schemes shown in FIGS. 5-7 makes it possible to accelerate the gradation output test at step S4.

Figure 9:
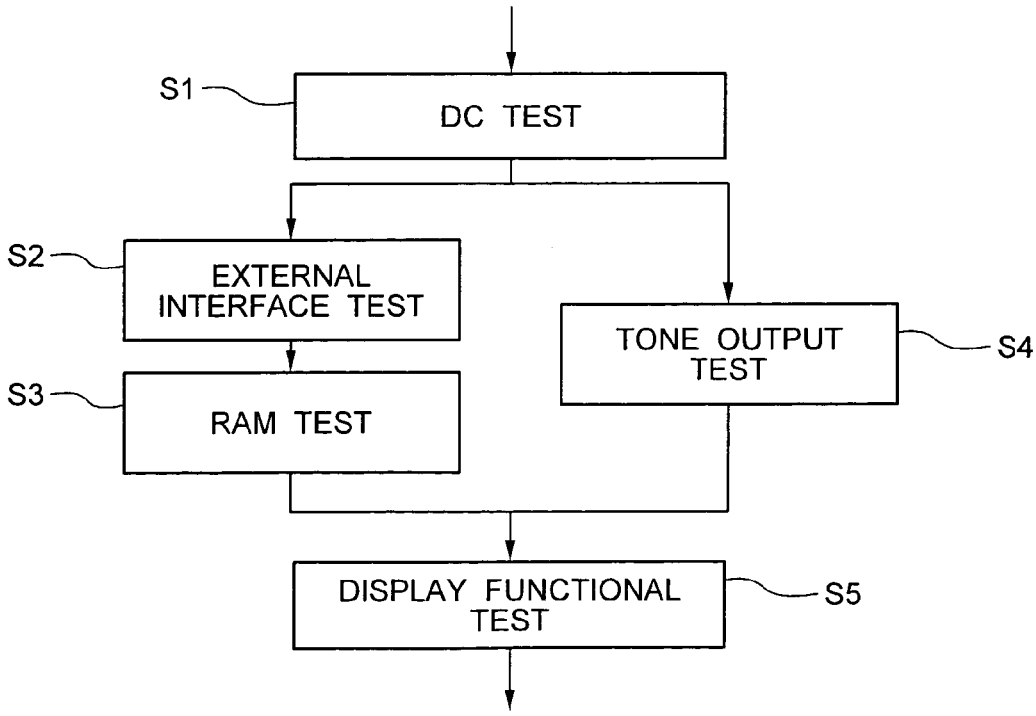
FIG. 9 is a test flow diagram showing a case for parallelization of the test items in one embodiment of the invention.
Figure 10:
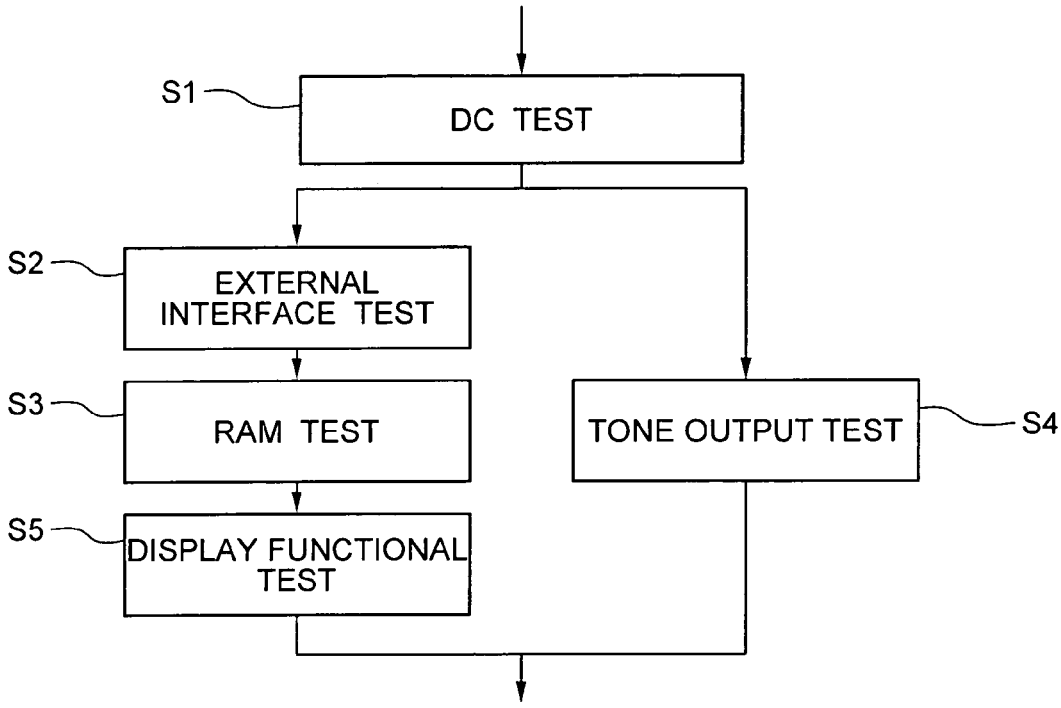
FIG. 10 is a test flow diagram showing another case for parallelization of the test items in one embodiment of the invention.

Alternatively as shown in FIG. 9, by using the schemes shown in FIGS. 2-4 to control the shift register 13 in a way independent of the external interface, it is possible to execute the external interface test (step S2) and the RAM test (step S3) on one hand and the gradation output test (step S4) on the other hand independently of each other. This in turn enables realization of acceleration owing to the parallel processing of the tests.

Still alternatively, using the scheme of FIG. 4 as shown in FIG. 10 makes it possible to conduct tests while separating the digital functional unit and the analog functional unit within the liquid crystal driver circuit from each other. Thus it is possible to execute in a parallel way the external interface test (step S2) and RAM test (step S3) and display function test (step S5) on one hand and the gradation output test (step S4) on the other hand. Thus it becomes possible to extensively reduce the test time required for the test procedure as a whole.

Accordingly, as per a semiconductor device having the liquid crystal driving circuit of this embodiment, it is possible to obtain the following effects and advantages.

(1) By functionally dividing a digital functional unit and an analog functional unit of the liquid crystal driver circuit, it is possible to perform testing of the digital function unit in a way independent of the analog function unit. Thus, it is possible to realize functional tests of the digital function unit at high speed.

(2) By changing over or switching an output voltage of the gradation voltage generating circuit 14 to a two-level voltage, it is possible to transform an output voltage of the liquid crystal driver circuit into a two-level voltage, which in turn makes it possible to realize high-speed gradation/gray-scale tests.

Although the invention made by the present inventors has been explained in detail based on the illustrative embodiments thereof, the present invention should not be limited only to the above-stated embodiments and, obviously, may be modifiable and alterable in a variety of forms without departing from the spirit and scope of the invention.

As has been stated previously, in accordance with the present invention, functionally dividing the digital function unit and the analog function unit of the liquid crystal driver circuit makes it possible to achieve high-speed functional tests of the digital function unit, which in turn enables achievement of cost reduction of the liquid crystal driver circuit owing to the shortening of a test time period.

In addition, according to this invention, by replacing a gradation output test with a switch test of a gradation voltage selector circuit, it becomes possible to achieve speed-up or acceleration of the gradation output test; thus, it is possible to realize cost reduction of the liquid crystal driver circuit owing to the shortening of the test time.

As a result, as per the invention, it becomes possible to realize further reduction of the test time even with respect to the quest for attaining higher functional of the liquid crystal driver circuit and an increase in number of output terminals. It is also possible to attain acceleration of the test at low costs even in a viewpoint of the testing technology of semiconductor devices having this liquid crystal driver circuit.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A semiconductor device including a liquid crystal driving circuit, said liquid crystal driving circuit comprising a digital functional unit, an analog functional unit, a shift register coupled between said digital functional unit and said analog functional unit, and a first terminal coupled to said shift register, at a last stage of the digital functional unit, for outputting an output of a test result of said digital functional unit toward outside of said liquid crystal driving circuit without passing through said analog functional unit.

2. The semiconductor device according to claim 1, wherein said digital functional unit includes a display controller and a random access memory (RAM) for storing display data, said analog functional unit includes a gradation voltage generating circuit and a gradation voltage selecting circuit, and said device includes hold means for holding an output of the display data storage RAM to read data held in said hold means to outside of said liquid crystal driving circuit through said first terminal and sets predetermined data in said hold means from outside of said liquid crystal driving circuit through said shift register.

3. A semiconductor device according to claim 1, wherein said shift register includes a plurality of shift registers.

4. The semiconductor device according to claim 2, wherein said shift register and/or said first terminal is used while sharing with a terminal for use during a normal operation.

5. A semiconductor device including a liquid crystal driving circuit, said liquid crystal driving circuit comprising a digital functional unit, an analog functional unit, and a shift register for functionally dividing said digital functional unit and said analog functional unit from each other and a first terminal coupled to the shift register, at a last stage of the digital functional unit, for controlling a test of said digital functional unit externally of said liguid crystal driving circuit independently of said analog functional unit and a second terminal for controlling a test of said analog functional unit externally of said liquid crystal driving circuit independently of said digital functional unit.

6. The semiconductor device according to claim 5, wherein said digital functional unit includes a display controller and a display data storage RAM, said analog functional unit includes a gradation voltage generating circuit and a gradation voltage selecting circuit, and said device includes hold means for holding an output of said display data storage RAM, reads data held in said hold means to outside of said liquid crystal driving circuit through a data output terminal and sets predetermined data in said hold means from outside of said liquid crystal driving circuit through said shift register.

7. A semiconductor device having a liquid crystal driving circuit, wherein said liquid crystal driving circuit comprises a digital functional unit and an analog functional unit and at least one shift register coupled between said digital functional unit and said analog functional unit, said digital functional unit including at least a display controller, and said analog functional unit including a gradation voltage generating circuit and a gradation voltage selecting circuit, and changeover means for changing an output of said gradation voltage generating circuit to a predetermined two-level voltage value, and further comprising a first terminal coupled to the shift register, at a last stage of the digital functional unit, for controlling a test of said digital functional unit externally of said liguid crystal driving circuit inderendently of said analog functional unit.

8. A testing method of a semiconductor device having a liquid crystal driving circuit including a digital functional unit and an analog functional unit, said method comprising the steps of:

functionally dividing said digital functional unit and said analog functional unit from each other using at least one shift register coupled between said digital functional unit and said analog functional unit; and outputting an output of a test result of said digital functional unit to outside of said liquid crystal driving circuit through a first terminal coupled to said at least one shift register, at a last stage of the digital functional unit, without passing through said analog functional unit.

9. The testing method of a semiconductor device according to claim 8, wherein said digital functional unit and said analog functional unit are controlled independently of each other to perform testing of said digital functional unit and testing of said analog functional unit in an overlapping manner.

10. The testing method of a semiconductor device according to claim 9, wherein the testing of said digital functional unit includes a display function test, and the testing of said analog functional unit includes a gradation output test.

11. A testing method of a semiconductor device having a liquid crystal driving circuit including a digital functional unit and an analog functional unit, the method comprising the steps of:

functionally dividing said digital functional unit using at least one shift register coupled between said digital functional unit and said analog functional unit;

controlling testing of said digital function unit externally of said liquid crystal driving circuit through a first terminal coupled to the shift register, at a last stage of the digital functional unit, for controlling a test of said digital functional unit externally of said liquid crystal driving circuit independently of said analog functional unit, controlling testing of said analog functional unit externally of said liquid crystal driving circuit through a second terminal so as to perform the testing of said analog functional unit independently of said digital functional unit.

12. The testing method of a semiconductor device according to claim 11, wherein said digital functional unit and said analog functional unit are controlled independently of each other to perform testing of said digital functional unit and testing of said analog functional unit in an overlapping manner.

13. The testing method of a semiconductor device according to claim 12, wherein the testing of said digital functional unit includes a display function test, and the testing of said analog functional unit includes a gradation output test.

14. A testing method of a semiconductor device having a liquid crystal driving circuit, said liquid crystal driving circuit including a digital functional unit with a display controller and a display data storage RAM, an analog functional unit with a gradation voltage generating circuit and a gradation voltage selecting circuit, and at least one shift register coupled between said digital functional unit and said analog functional unit; said method comprising the steps of:

changing an output of said gradation voltage generating circuit to a two-level voltage value by a changeover means;

selectively setting each gradation voltage at one of different two-level voltage values;

changing an output voltage of said liquid crystal driving circuit to a two-level voltage to thereby perform a gradation output test, and controlling testing of said digital functional unit externally of said liquid crystal driving circuit through a first terminal coupled to the shift register, at a last stage of the digital functional unit, for controlling a test of said digital functional unit externally of said liquid crystal driving circuit independently of said analog functional unit.

15. A semiconductor device including a liquid crystal driving circuit, said liquid crystal driving circuit comprising:

a digital functional unit;

an analog functional unit;

a plurality of shift registers coupled between said digital functional unit and said analog functional unit; and a terminal coupled to said plurality of shift register, at a last staQe of the digital functional unit, for outputting an output of a test result of said digital functional unit toward outside of said liquid crystal driving circuit without passing through said analog functional unit.

* * * * *